US006131590A

United States Patent [19]

Kuang et al.

[11] Patent Number: 6,131,590

[45] Date of Patent: Oct. 17, 2000

[54] COLLAPSIBLE UMBRELLA STRUCTURE WITH HAND PROTECTION

[76] Inventors: Lin Chung Kuang; Jung Jen Chang, both of No. 16, Cherng-Tai Rd., Sec. 3, Wu-Ku Shiang, Taipei Hsien, Taiwan

[21] Appl. No.: 09/146,462

[22] Filed: Sep. 3, 1998

[30] Foreign Application Priority Data

Oct. 9, 1997 [TW] Taiwan ..... 86217116

[51] Int. Cl.[7] ..... A45B 25/06

[52] U.S. Cl. ..... 135/28; 135/39

[58] Field of Search ..... 135/15.1, 20.3, 135/22, 28, 37–40, 41

[56] References Cited

U.S. PATENT DOCUMENTS

| | | | |
|---|---|---|---|
| 5,357,994 | 10/1994 | Chung | 135/22 |
| 5,398,709 | 3/1995 | Lee | 135/28 |
| 5,494,064 | 2/1996 | Lee | 135/28 |
| 5,588,455 | 12/1996 | Kuo | 135/28 |
| 5,615,698 | 4/1997 | Ko | 135/28 |
| 5,732,725 | 3/1998 | Ko | 135/28 |
| 5,740,824 | 4/1998 | Tang | 135/28 |
| 5,911,233 | 6/1999 | Wu | 135/28 |

*Primary Examiner*—Beth A. Stephan
*Attorney, Agent, or Firm*—Ezra Sutton

[57] ABSTRACT

A collapsible umbrella structure with hand protection is provided, which is constructed in such a manner that can help prevent the user's hand from being injured when the user is using his/her hand to manually open or collapse the umbrella. The collapsible umbrella structure includes a main shaft; a running hub slidably movable along the main shaft, the running hub being held at a bottom position when the umbrella is collapsed and at an upper position when the umbrella is opened; and an upper pressable stopper, pressably mounted on the main shaft, for holding the running hub at an upper position when the umbrella is opened. The upper pressable stopper is pressed down by the running hub when the running hub is being manually moved from the bottom position to the upper position, and subsequently capable of restoring to the unpressed position after the running hub has passed therethrough so as to stop the running hub from moving downwards, thereby holding the running hub at the upper position. This collapsible umbrella structure allows the user's hand not to come in touch with some sharp edges that are formed by machine cutting on the umbrella, thus able to help prevent the user's hand from being injured when the user is using his/her hand to manually open or collapse the umbrella.

8 Claims, 8 Drawing Sheets

COLLAPSIBLE UMBRELLA STRUCTURE WITH HAND PROTECTION

BACKGROUND OF THE INVENTION

1. Field of the Invention

This invention relates to umbrella structures, and more particularly, to a collapsible umbrella structure with hand protection, which is constructed in such a manner that can help prevent the user's hand from being injured when the user is using his/her hand to manually open or collapse the umbrella.

2. Description of Related Art

An umbrella with a collapsible mechanism allows the user to collapse the umbrella for easy storage or carriage when the umbrella is not in use. When raining, the collapsible umbrella can be either automatically opened by an elastic means or by manually stretching the umbrella with hand after a stopper is released. A conventional collapsible umbrella structure is shown in FIG. 1. It is to be noted that throughout this specification, the terms "upper" and "bottom" are referred in reference to the normal orientation of the umbrella when being used to shield from sunshine or rain; i.e., "upper" refers to a position substantially near the fabric side of the umbrella, while the term "bottom" refers to a position substantially near the handle side of the umbrella.

As shown in FIG. 1, the collapsible umbrella structure includes a main shaft 1 on which an upper pressable stopper 11 and a bottom pressable stopper 12 are provided. Moreover, the collapsible umbrella structure includes a frame of radiating ribs 2 for supporting the shielding fabric of the umbrella and a running hub 21 at which the radiating ribs 2 are centered. In collapsed state of the umbrella, the running hub 21 is positioned at the bottom pressable stopper 12 which can stop the running hub 21 from moving upwards. To open the umbrella, the user needs just to press down the bottom pressable stopper 12 and then use hand to manually move the running hub 21 upwards until it is stopped from moving downwards by the upper pressable stopper 11. Another type of umbrella is provided with elastic means that can move the running hub upwards automatically.

Detailed structure of the upper pressable stopper 11 is shown in FIGS. 2A–2B, wherein FIG. 2A shows the upper pressable stopper 11 in pressed state, while FIG. 2B shows the upper pressable stopper 11 in unpressed state. As shown, the upper pressable stopper 11 is formed with a stop portion 111 and a substantially L-shaped bendable leg 112. Further, the stop portion 111 is formed with an inclined portion 1111 on the bottom side and an erect portion 1112 on the upper side, which is substantially in perpendicular to the longitudinal axis of the main shaft 1.

When the running hub 21 is being moved upwards by the user's hand, it will first meet and urge against the inclined portion 1111 of the stop portion 111 of the upper pressable stopper 11, thereby pressing the stop portion 111 into the hollowed inside of an elongated slot 13 in the main shaft 1, as illustrated in FIG. 2A, thus allowing the running hub 21 to pass through the upper pressable stopper 11. After passing through the upper pressable stopper 11, the stop portion 111 can be restored to the surface position from the slot 13 due to the elasticity from the bendable leg 112. As a result, the running hub 21 is abutted on and thus stopped by the erect portion 1112 of the stop portion 111 of the upper pressable stopper 11 from moving downwards, as illustrated in FIG. 2B, thereby allowing the radiating ribs 2 to be extended out to support the shielding fabric (not shown) of the umbrella.

To collapse the umbrella, the user needs just to press down on the stop portion 111 of the upper pressable stopper 11 by hand. This allows the running hub 21 to be released from the stoppage by the upper pressable stopper 11, and thus can be moved downwards back to the bottom position, whereby the umbrella is collapsed.

FIGS. 3A–3B are perspective views of the collapsible umbrella structure of the invention, which are used to depict the operation of the umbrella. When collapsing the umbrella, the user would habitually use his/her hand to grab the main shaft 1 and then move his/her hand upwards along the main shaft 1 until his/her hand touches the stop portion 111 of the upper pressable stopper 11. The user can then press down his/her hand upon the upper pressable stopper 11 to allow the stoppage on the running hub 21 to be removed. In the conventional collapsible umbrella structure, however, the elongated slot 13 is customarily formed by machine cutting, which would cause the edges of the elongated slot 13 to be so sharp that they can cause injury to the user's hand when the user's hand touches the elongated slot 13. Moreover, the upper pressable stopper 11, due to its sharp edges, can also cause injury to the user's hand.

SUMMARY OF THE INVENTION

It is therefore an objective of the present invention to provide a collapsible umbrella structure, which would help prevent the user's hand from being injured when the user is using his/her hand to manually collapse the umbrella.

In accordance with the foregoing and other objectives of the present invention, an improved collapsible umbrella structure is provided. In this specification, four preferred embodiments are disclosed.

In accordance with the first preferred embodiment, the collapsible umbrella structure of the invention includes a main shaft having an elongated slot; a running hub slidably movable along the main shaft, the running hub being held at a bottom position when the umbrella is set in collapsed state and at an upper position when the umbrella is set in opened state; and an upper pressable stopper, pressably mounted in the elongated slot in the main shaft, for holding the running hub at the upper position when the umbrella is opened; the upper pressable stopper being formed with a stop portion and a substantially L-shaped bendable leg having a first end linked to the stop portion and second end fixed to the main shaft on the upper side of the elongated slot. The stop portion of the upper pressable stopper is pressed down by the running hub when the running hub is moving from the bottom position to the upper position, and subsequently capable of restoring to the unpressed position after the running hub has passed therethrough so as to stop the running hub from moving downwards, thereby holding the running hub at the upper position.

Preferably, the stop portion and the bendable leg of the upper pressable stopper are integrally formed in one piece. The upper pressable stopper is formed with a stop portion and a substantially L-shaped bendable leg having a first end linked to the stop portion and a second end fixed to the main shaft on the upper side of the elongated slot. Further, the stop portion is formed with an inclined portion on the bottom side of the stop portion and an erect portion on the upper side of the stop portion; and wherein the upper pressable stopper is mounted in such a manner that the stop portion thereof is positioned at a bottom position relative to the bendable leg thereof, allowing the running hub to cover the part of the elongated slot where the bendable leg is positioned.

In accordance with the second preferred embodiment, the collapsible umbrella structure of the invention includes a main shaft having a mounting hole; a running hub slidably movable along the main shaft, the running hub being held at a bottom position when the umbrella is collapsed and at an upper position when the umbrella is opened; and an upper pressable stopper, pressably mounted in the mounting hold in the main shaft and substantially with the same cross sectional dimensions as the mounting hole, for holding the running hub at an upper position when the umbrella is opened; the upper pressable stopper being pressed down by the running hub when the running hub is moving from the bottom position to the upper position, and subsequently capable of being restored to the unpressed position after the running hub has passed therethrough so as to stop the running hub from moving downwards, thereby holding the running hub at the upper position.

The upper pressable stopper includes a pin mounted in the mounting hole in the main shaft; and elastic means coupled to the pin to allow the pin to be pressably mounted in the mounting hole in the main shaft.

In the second preferred embodiment, the structure for mounting the upper pressable stopper is a hole rather than an elongated slot, allowing the user's hand to be further less likely to come into touch with the shaft edges of the hole.

In accordance with the third preferred embodiment, the collapsible umbrella structure of the invention further includes a pressing member formed on the outer side of the running hub, which is positioned in such a manner that when the running hub is stopped by the upper pressable stopper, the pressing member is directly located on the upper pressable stopper, allowing a user to release the stoppage of the upper pressable stopper on the running hub by pressing on the pressing member.

In accordance with the fourth preferred embodiment, the upper pressable stopper is further formed with an upper stop portion substantially in the middle of the L-shaped bendable leg so as to stop the running hub from moving upwards when the running hub is held at the upper position.

BRIEF DESCRIPTION OF DRAWINGS

The invention can be more fully understood by reading the following detailed description of the preferred embodiments, with reference made to the accompanying drawings, wherein:

FIGS. 2A–2B are enlarged views of the upper pressable stopper used in the conventional collapsible umbrella structure of FIG. 1 with part cutaway to shown the inside structure; wherein FIG. 2A shows the upper pressable stopper in pressed state, while FIG. 2B shows the same in unpressed state;

FIGS. 4A–4B are perspective views of a first preferred embodiment of the collapsible umbrella structure according to the invention; wherein FIG. 4A shows the upper pressable stopper in pressed state, while FIG. 4B shows the same in unpressed state;

FIGS. 7A–7B are perspective views of a second preferred embodiment of the collapsible umbrella structure according to the invention; wherein FIG. 7A shows the upper pressable stopper in pressed state, while FIG. 7B shows the same in unpressed state;

DETAILED DESCRIPTION OF PREFERRED EMBODIMENTS

First Preferred Embodiment

A first preferred embodiment of the collapsible umbrella structure of the invention is disclosed in the following with reference to FIGS. 4A–4B, 5, and 6.

Figure 1:
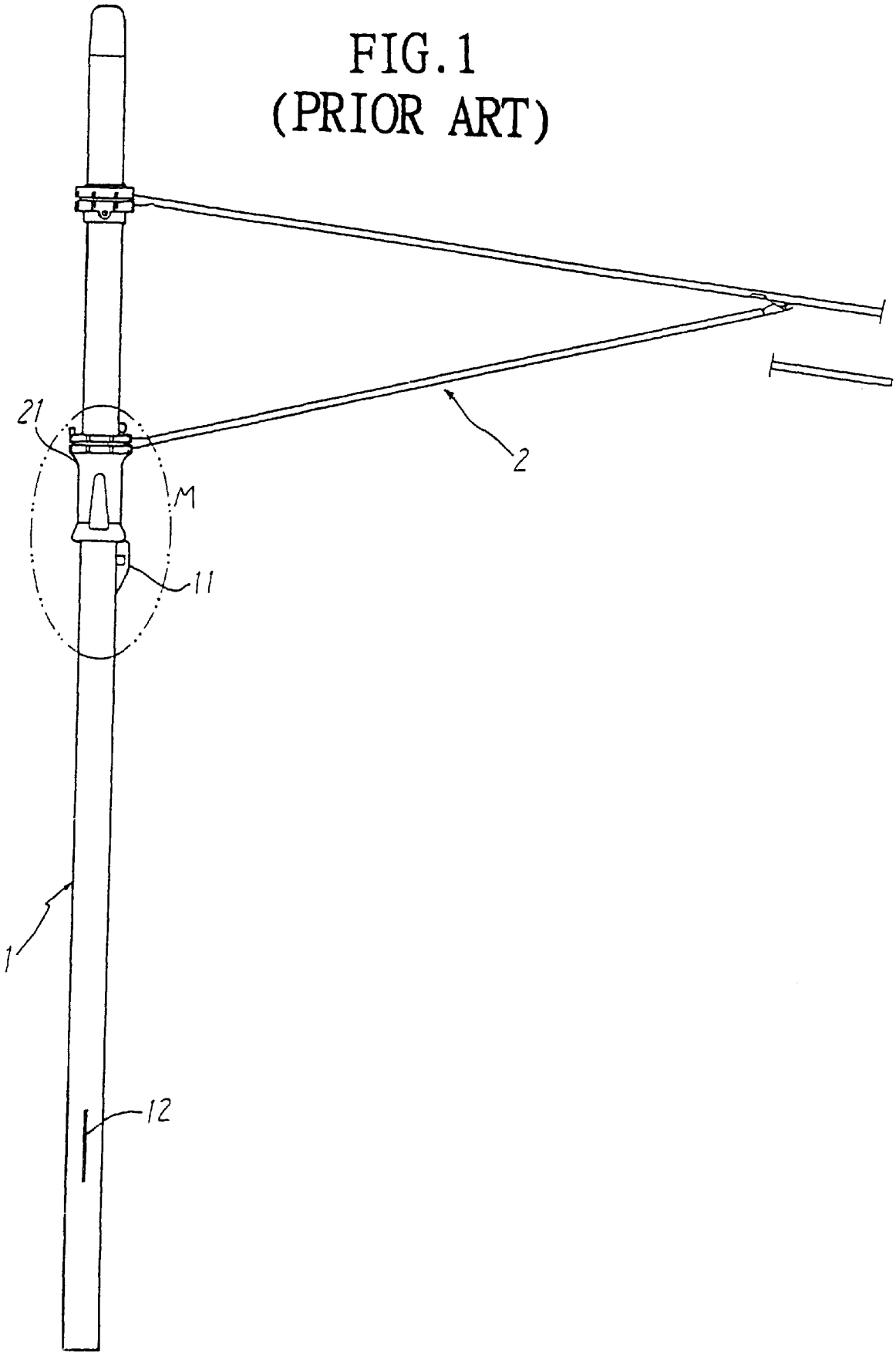
FIG. 1 (PRIOR ART)
FIG. 1 is a side view showing a conventional collapsible umbrella structure.
Figure 2B:
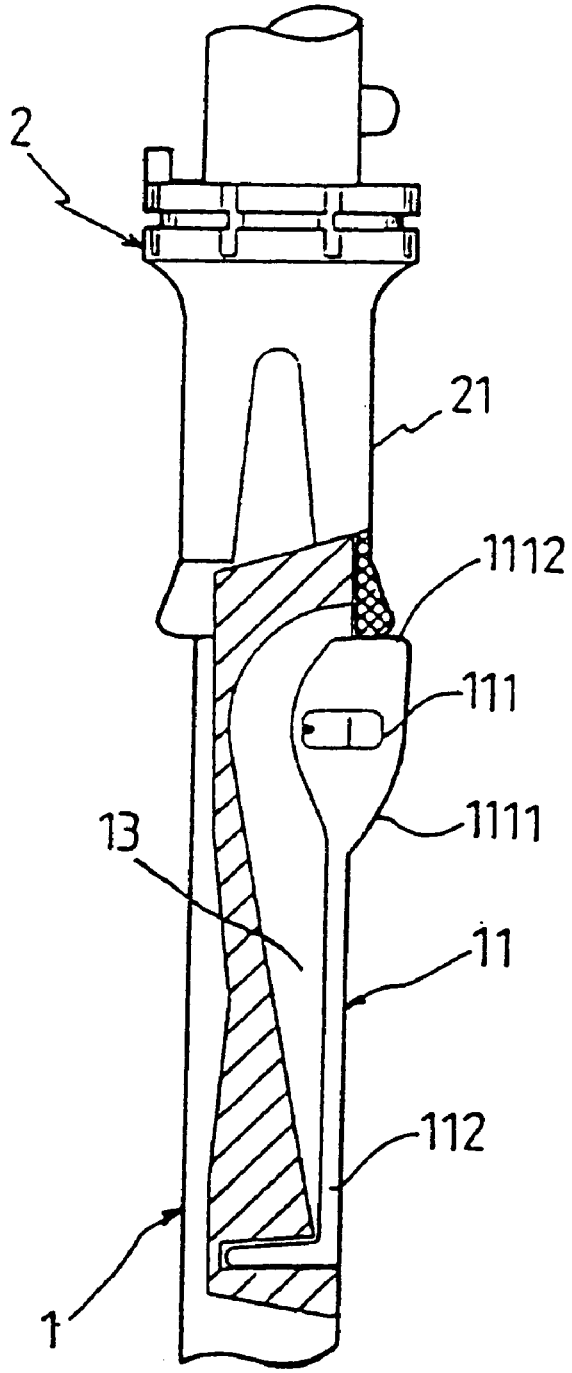
FIG.2(B) (PRIOR ART)
Figure 2A:
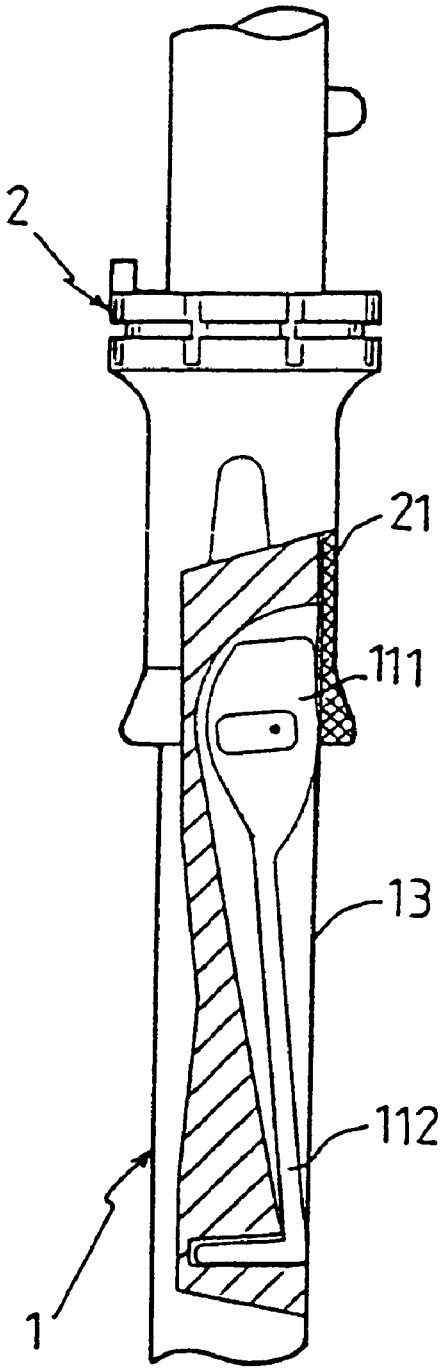
FIG.2(A) (PRIOR ART)
Figure 3A:
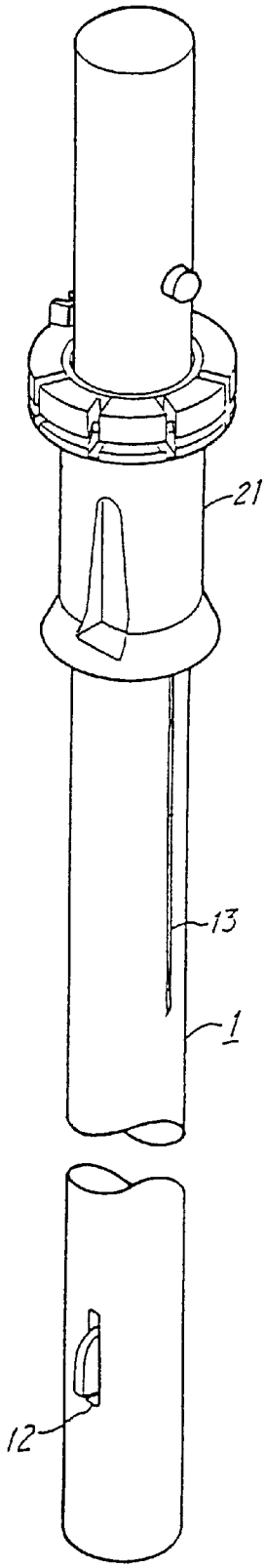
FIG.3(A) (PRIOR ART)
FIGS. 3A–3B are perspective views showing the main shaft, the upper pressably stopper, and the running hub of the conventional collapsible umbrella structure of FIG. 1.
Figure 3B:
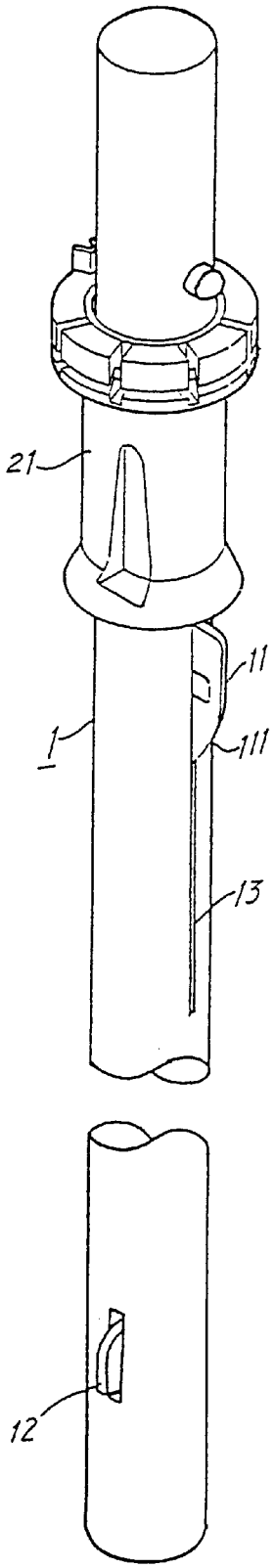
FIG.3(B) (PRIOR ART)
Figure 4A:
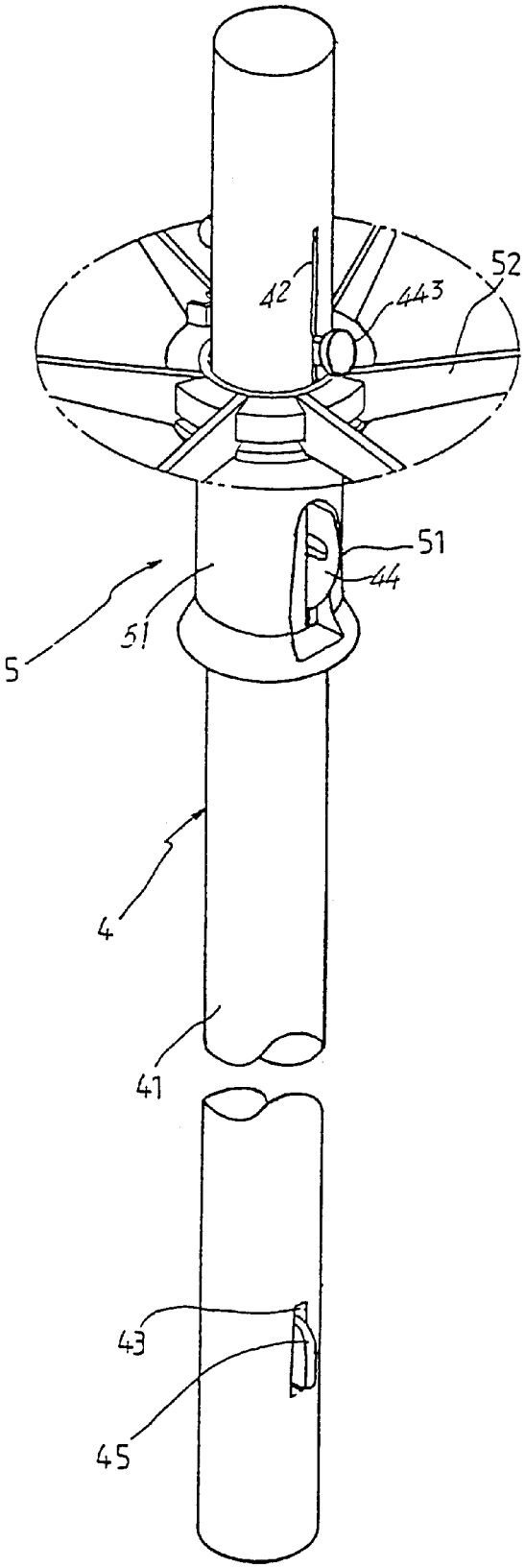
Figure 4B:
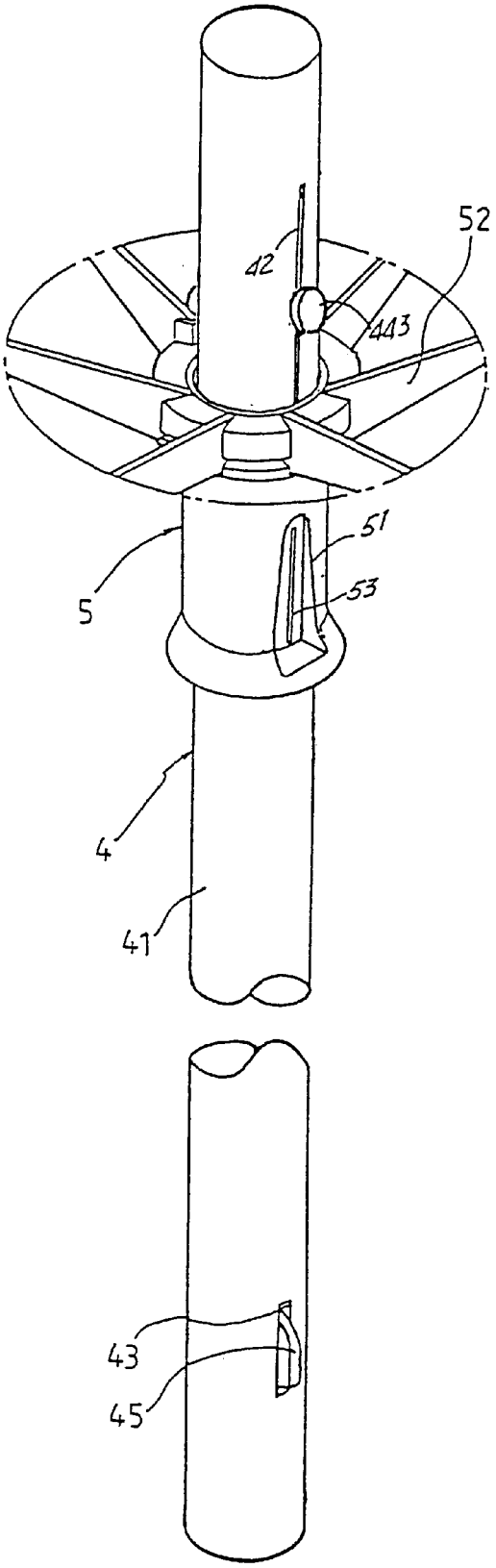

FIGS. 4A–4B are perspective views showing the first preferred embodiment of the collapsible umbrella structure according to the invention. As shown, the collapsible umbrella structure of this embodiment includes basically a main shaft 4 and a frame 5 consisting of a plurality of radiating ribs 52 for supporting a shielding fabric (not shown). Further, the collapsible umbrella structure includes a running hub 51 slidably mounted on the main shaft 4, a bottom pressable stopper 45 pressable mounted in a slot 43 near the bottom of the umbrella, and an upper pressable stopper 44 pressably mounted in an elongated slot 42 near the top of the umbrella.

Figure 5:
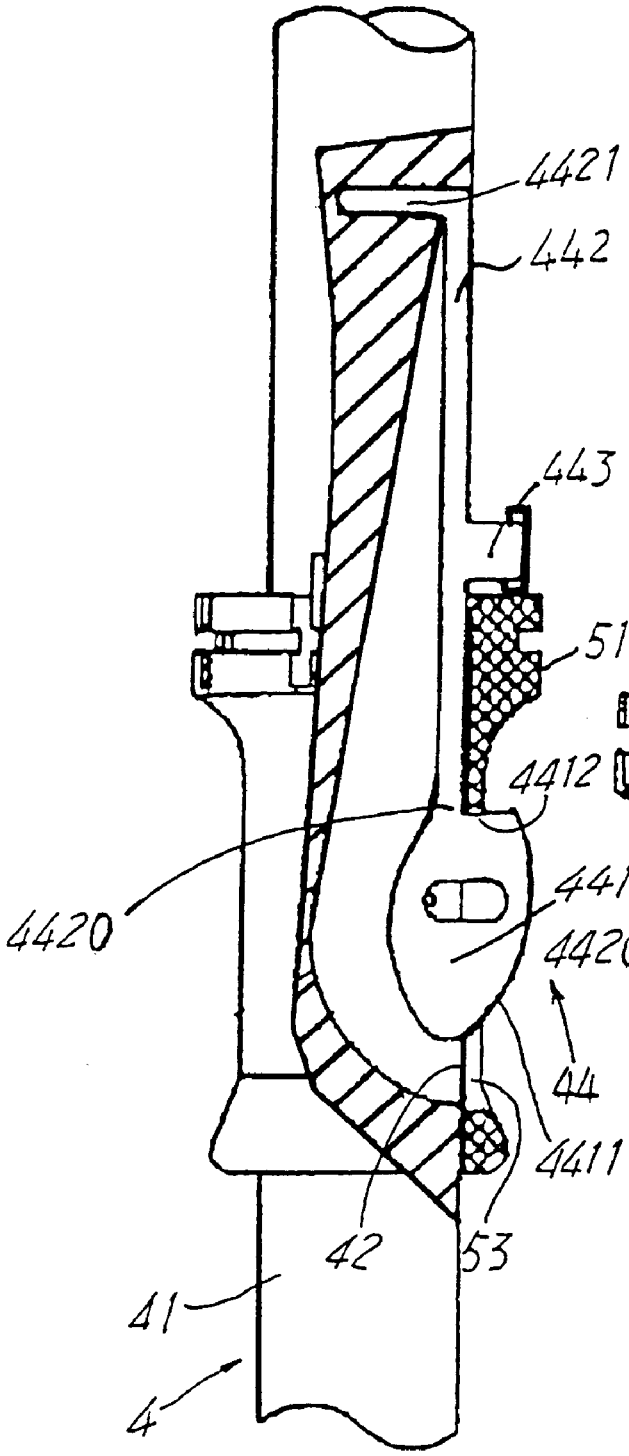
FIG. 5 is a longitudinal sectional view of the main shaft of the collapsible umbrella structure of FIGS. 4A–4B, showing particularly the upper pressable stopper in unpressed state.
Figure 6:
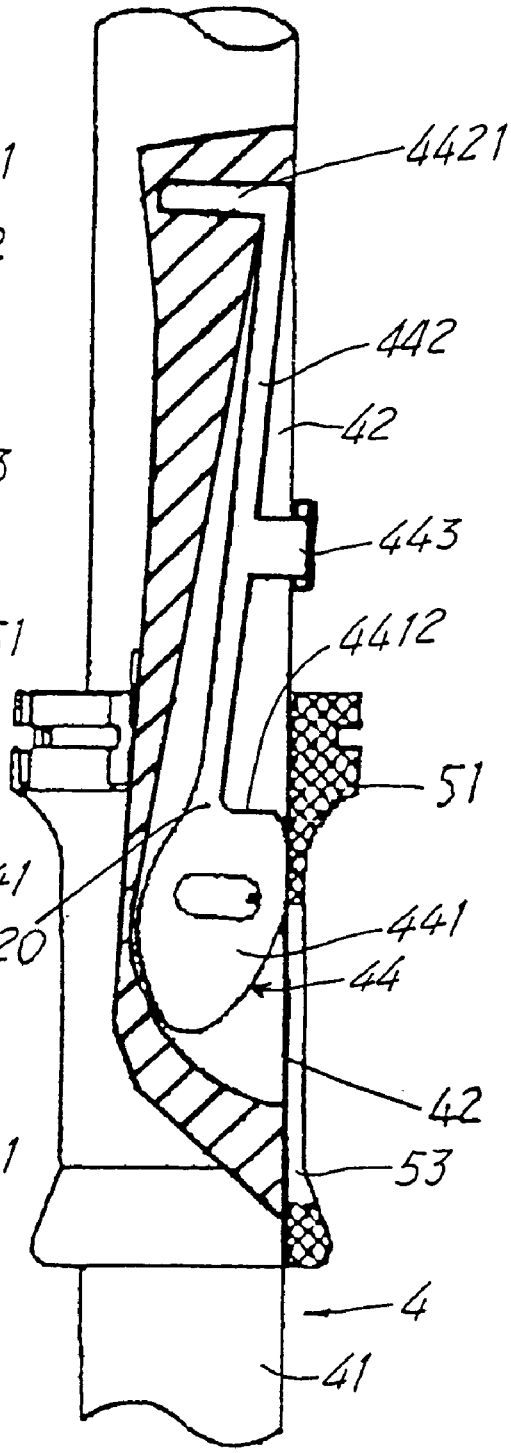
FIG. 6 shows the same of FIG. 5 except when the upper pressable stopper is in pressed state.

Referring also to FIGS. 5–6, the upper pressable stopper 44 is formed with a stop portion 441 and a substantially L-shaped bendable leg 442 having a first end 420 linked integrally to the stop portion 441 and a second end 4421 fixed to the main shaft 4 at a position near the upper side of the slot 42. It is a characteristic part of the invention, as compared to the prior art, that the upper pressable stopper 44 is mounted in such a manner that the stop portion 441 is positioned at a bottom position relative to the bendable leg 442 thereof; and the stop portion 441 is formed with an inclined portion 4411 on the bottom side of the stop portion 441 and an erect portion 4412 on the upper side of the stop portion 441 at the junction between the bendable leg 442 and the stop portion 441.

The L-shaped bendable leg 442, is further formed with an upper stop portion 443 in the middle of the bendable leg 442.

The bottom pressable stopper 45 is identical in function and structure as the prior art and not within the spirit and scope of the invention, so description thereof will not be further detailed.

Further, the frame 5, the running hub 51, and the radiating ribs 52 shown in FIGS. 4A–4B are generally identical in function and structure as the prior art, except that the running hub 51 is provided with a slot 53 as an access port of the upper pressable stopper 44.

Referring to FIGS. 4A–4B together with FIGS. 5–6, when the umbrella is set in collapsed state, the running hub 51 is stopped by the bottom pressable stopper 45 and is thus held in position at the bottom pressable stopper 45. To open the umbrella, the user needs just to press down the bottom pressable stopper 45 to release the stoppage on the running hub 51, and then move the running hub 51 upwards by hand along the main shaft 4. When the running hub 51 meets the upper pressable stopper 44, it will urge against the inclined portion 4411 of the stop portion 441 of the upper pressable stopper 44, thereby pressing the stop portion 441 down into the hollowed inside of the elongated slot 42, thus allowing the running hub 51 to pass over the upper pressable stopper 44, as illustrated in FIG. 6. After the upper end of the slot 53 of the running hub 51 has passed over the erect portion 4412 of the stop portion 441 of the upper pressable stopper 44, the stop portion 441 will be restored from the inside of the slot 42 and protrudes from the slot 53 of the running hub 51, thereby allowing the erect portion 4412 to stop the running hub 51 from moving downwards, as illustrated in FIG. 5. The running hub 51 is thus securely held at the upper pressable stopper 44, thus allowing the radiating ribs 52 to be extended to support the shielding fabric (not shown) of the umbrella.

The upper stop portion 443 here can stop the running hub 51 from moving further upwards when the running hub 51 is held at the upper position, thereby allowing the running hub 51 to be more securely held at the upper position.

It can be learned from the foregoing description that the upper pressable stopper 44 and the elongated slot 42 in this preferred embodiment of the invention is designed in such a manner as to allow the elongated slot 42 to be mostly covered by the running hub 51 when the running hub 51 is held at the upper position by the upper pressable stopper 44, as illustrated in FIG. 5. As a benefit of this, the user's hand would not come in touch with the elongated slot 42 when the user is trying to collapse the umbrella. The collapsible umbrella structure of the invention would therefore not cause injury to the user's hand when the user is trying to collapse the umbrella as in the case of the prior art.

Second Preferred Embodiment

Figure 7A:
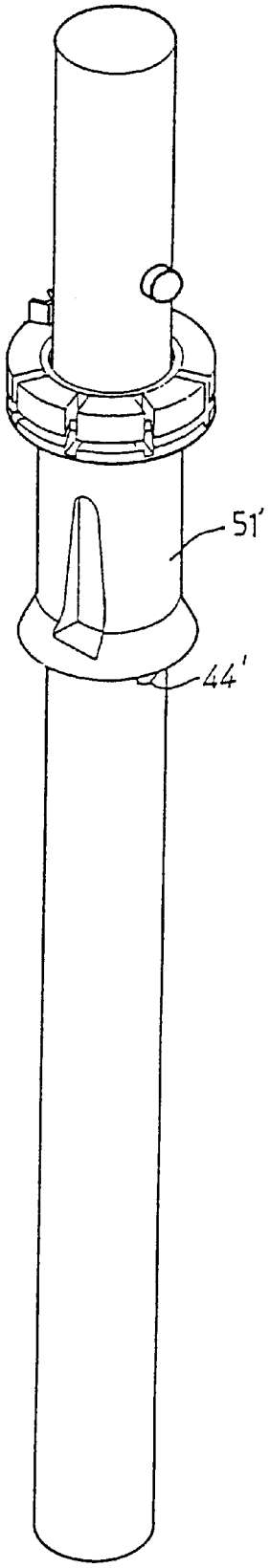

A second preferred embodiment of the collapsible umbrella structure of the invention is disclosed in the following with reference in FIGS. 7A–7B, 8, and 9. In these drawings, the reference numerals are appended with a single prime mark ' for distinguishing purposes. FIG. 7A shows the upper pressable stopper 44' pressed into pressed state by the running hub 51', while FIG. 7B shows upper pressable stopper 44' in unpressed state to hold the running hub 51' at the upper position.

This embodiment differs from the previous one particularly in that the upper pressable stopper 44' is here structured in a different manner. This upper pressable stopper 44' is specifically designed for the purpose of significantly reducing the longitudinal dimension of the elongated slot that is used in the previous embodiment.

Figure 8:
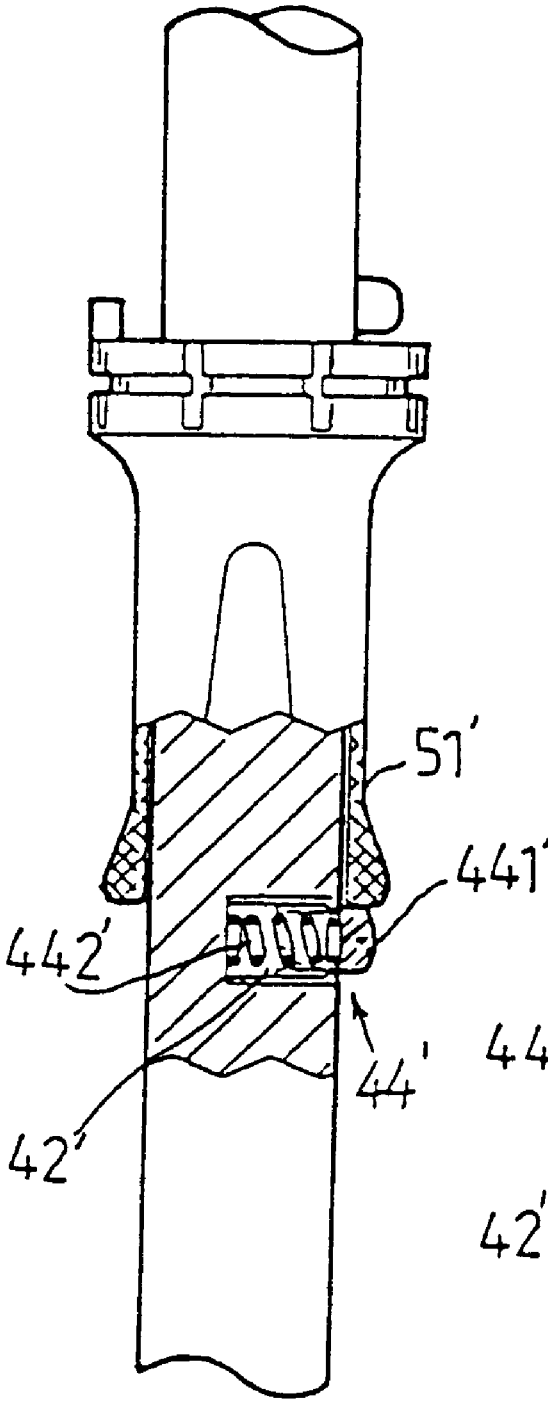
FIG. 8 is a longitudinal sectional view of the main shaft of the collapsible umbrella structure of FIGS. 7A–7B, showing particularly the upper pressable stopper in unpressed state.
Figure 9:
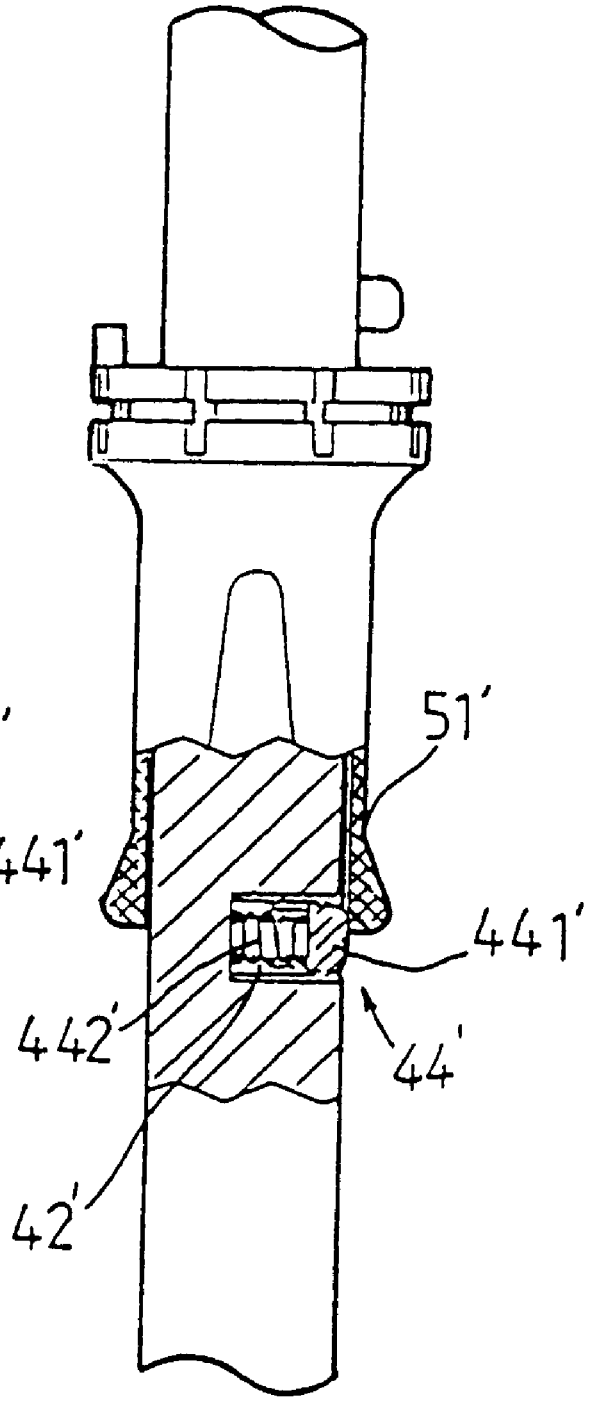
FIG. 9 shows the same of FIG. 8 except when the upper pressable stopper is in pressed state.

As shown in FIGS. 8–9, the upper pressable stopper 44' is mounted in a hole 42' rather than in an elongated slot as in the previous embodiment. The upper pressable stopper 44' includes a pin 441' and an elastic member 442' coupled to the pin 441'. The elastic means can be compressed when the pin 441' is pressed down and then allows the pin 441' to be restored to the surface position when the external force exerted on the pin 441' is removed. The elastic means 442' can be, for example, a spiral spring sleeved on the pin 441'.

Figure 7B:
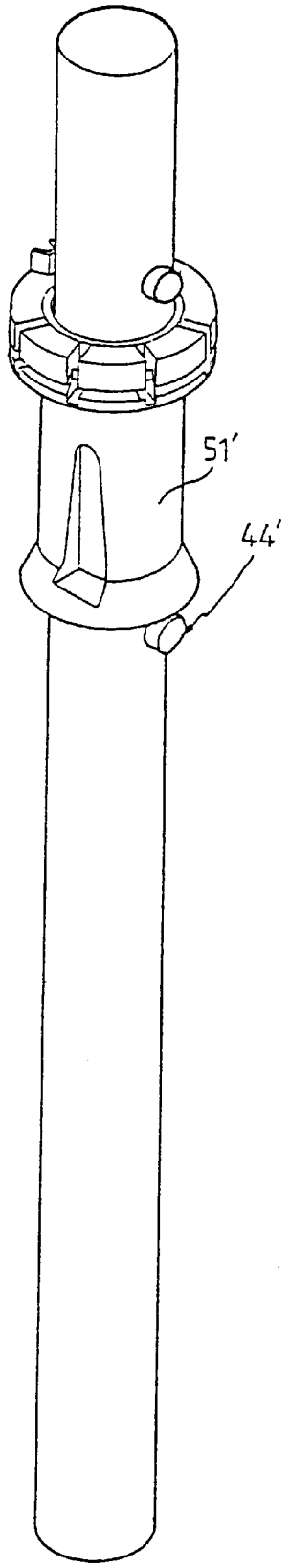

Referring to FIGS. 7A–7B together with FIGS. 8–9, when the umbrella is being opened, the running hub 51' will meet and urge against the pin 441' of the upper pressable stopper 44', thus pressing the pin 441' down into the hole 42', as illustrated in FIG. 9.

After the running hub 51' has completely passed through the upper pressable stopper 44', the pin 441' can be restored from the inside of the hole 42 back to the surface position, thereby stopping the running hub 51 from moving downwards, as illustrated in FIG. 9. The running hub 51' is thus held at the upper pressable stopper 44', allowing the umbrella to be held in the opened state. To collapse the umbrella, the user needs just to press down on the pin 441' to release the running hub 51' from the stoppage.

Third Preferred Embodiment

Figure 10:
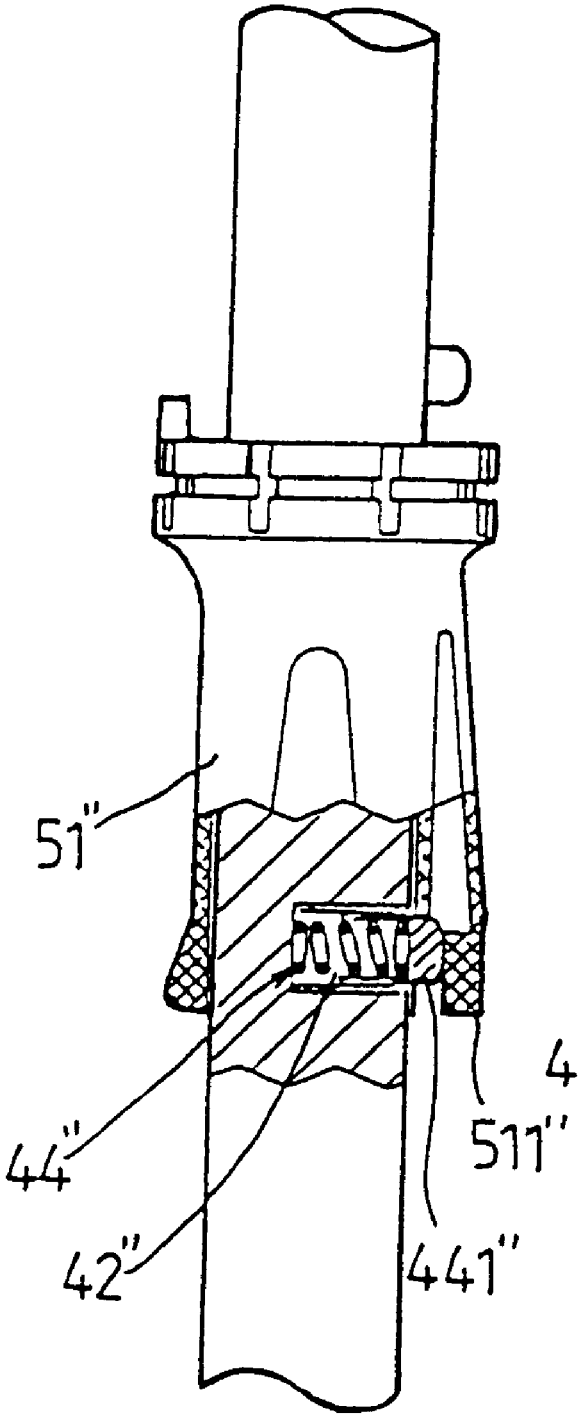
FIG. 10 is a longitudinal sectional view of part of the main shaft of the collapsible umbrella structure of the third preferred embodiment of the invention, showing particularly the upper pressable stopper in unpressed state.
Figure 11:
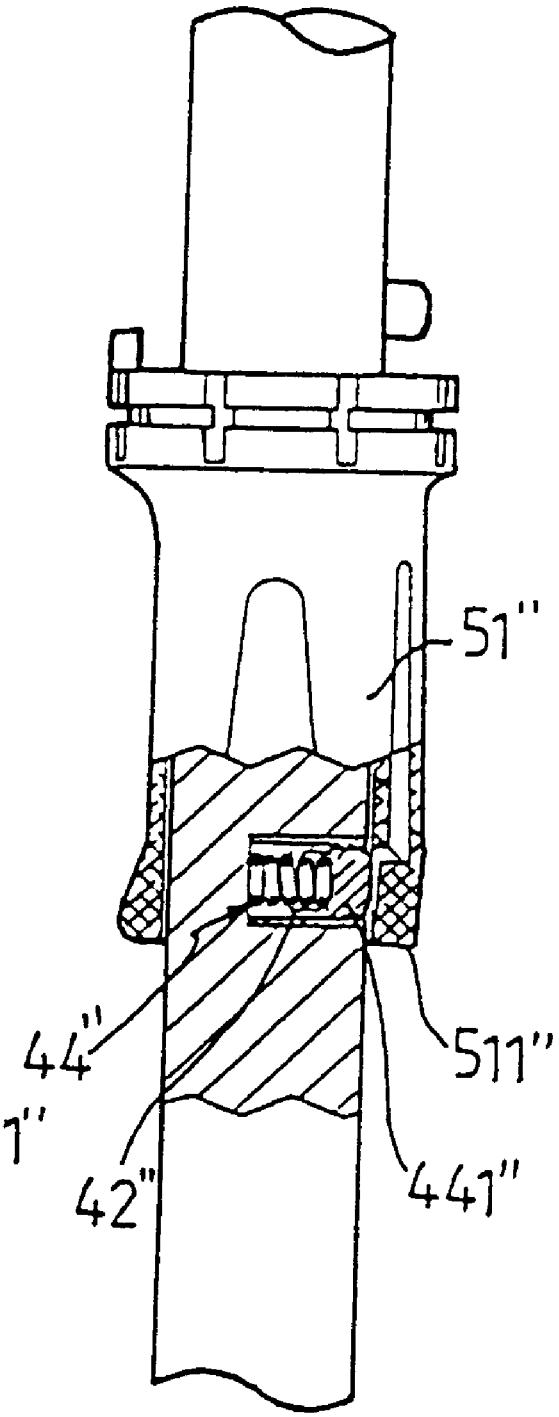
FIG. 11 shows the same of FIG. 10 except when the upper pressable stopper is in pressed state.

A third preferred embodiment of the collapsible umbrella structure of the invention is disclosed in the following with reference to FIGS. 10 and 11. In these drawings, the reference numerals are appended with a double prime mark " for distinguishing purpose.

This embodiment is mostly identical with the previous second embodiment, except that the running hub 51" in this embodiment is additionally formed with a pressing member 511" on the outer side thereof. When the running hub 51" is stopped by the stop portion 441" of the upper pressable stopper 44", the head of the pressing member 511" is directly located on the stop portion 441", as illustrated in FIG. 10. To collapse the umbrella, the user needs just to press his/her hand on the pressing member 511" to thereby push the stop portion 441" into the hole 42", as illustrated in FIG. 11. This allows the stoppage of the pin 441' of the upper pressable stopper 44" on the running hub 51" to be removed, thereby allowing the radiating ribs 52 to move down to the bottom position to collapse the umbrella.

This embodiment particularly allows the user's hand not to come into touch with any sharp edges of the various constituent parts of the collapsible umbrella structure that are formed by machine cutting. Therefore, the user's hand can be protected from being injured when he/she is trying to collapse the umbrella.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A collapsible umbrella structure, which comprises:

a main shaft having an elongated slot having an upper end and a lower end;

a running hub slidably movable along the main shaft, the running hub being held at a bottom position when the umbrella is set in a collapsed state and at an upper position when the umbrella is set in an opened state; and an upper pressable stopper, pressably mounted in the lower end of the elongated slot in the main shaft, for holding said running hub at the upper position when the umbrella is opened;

said upper pressable stopper being formed with a stop portion and a substantially L-shaped bendable leg having a first lower end linked to the stop portion and a second upper end fixed to the main shaft on the upper end of the elongated slot;

wherein said stop portion of the upper pressable stopper is capable of being moved into said main shaft by the running hub when the running hub is moving from the bottom position to the upper position, and subsequently capable of being restoring to the unpressed position after the running hub has passed thereby so as to stop the running hub from moving downwards, thereby holding said running hub at said upper position.

2. The collapsible umbrella structure of claim 1, wherein the stop portion and the bendable leg of the upper pressable stopper are integrally formed in one piece.

3. The collapsible umbrella structure of claim 1, wherein the stop portion includes a bottom side with an inclined portion formed thereon and an upper side with an erect portion formed thereon; and wherein the upper pressable stopper is mounted in such a manner that the stop portion thereof is positioned at a bottom position relative to the bendable leg thereof, allowing the running hub to cover the part of the elongated slot where the stop portion of the bendable leg is positioned.

4. The collapsible umbrella structure of claim 1, wherein the upper pressable stopper is further formed with an upper stop portion substantially in the middle of the L-shaped bendable leg so as to stop the running hub from moving upwards when the running hub is held at the upper position.

5. A collapsible umbrella structure, which comprises:

a main shaft having a mounting hole;

a running hub slidably movable along the main shaft, the running hub being held at a bottom position when the umbrella is set in a collapsed state and at an upper position when the umbrella is set in an opened state; and said running hub having an inner wall surface integrally formed with said running hub and non-movable relative thereto for engaging said main shaft as said running hub is moved along said main shaft;

an upper pressable stopper, pressably mounted in the mounting hole in said main shaft and substantially with the same cross sectional dimensions as the mounting hole, for holding said running hub at an upper position when the umbrella is opened;

wherein the upper pressable stopper is capable of being moved into said main shaft by said inner wall surface of the running hub when the running hub is moving from the bottom position to the upper position, and subsequently capable of being restoring to the unpressed position after the running hub has passed thereby so as to stop the running hub from moving downwards, thereby holding the running hub at said upper position.

6. The collapsible umbrella structure of claim 5, wherein the upper pressable stopper includes:

a pin mounted in the mounting hole in the main shaft; and elastic means coupled to the pin to allow the pin to be pressable mounted in the mounting hole in the main shaft.

7. The collapsible umbrella structure of claim 6, wherein the elastic means is a spiral spring sleeved on the pin.

8. The collapsible umbrella structure of claim 5, further comprising:

said running hub having an outer side, a pressing member formed on the outer side of the running hub, which is positioned in such a manner that when the running hub is stopped by the upper pressable stopper, the pressing member is directly located on the upper pressable stopper, allowing a user to release the stoppage of the upper pressable stopper on the running hub by pressing on the pressing member.

* * * * *